US010173425B2

(12) United States Patent
Irokawa

(10) Patent No.: US 10,173,425 B2
(45) Date of Patent: Jan. 8, 2019

(54) LIQUID EJECTION HEAD, METHOD FOR MANUFACTURING LIQUID EJECTION HEAD, LIQUID EJECTION APPARATUS

(71) Applicant: SII Printek Inc., Chiba-shi, Chiba (JP)

(72) Inventor: Daiki Irokawa, Chiba (JP)

(73) Assignee: SII PRINTEK INC., Chiba (JP)

( * ) Notice: Subject to any disclaimer, the term of this patent is extended or adjusted under 35 U.S.C. 154(b) by 0 days.

(21) Appl. No.: 15/702,236

(22) Filed: Sep. 12, 2017

(65) Prior Publication Data

US 2018/0086063 A1 Mar. 29, 2018

(30) Foreign Application Priority Data

Sep. 29, 2016 (JP) ..... 2016-191715

(51) Int. Cl.
*B41J 2/14* (2006.01)
*B41J 2/16* (2006.01)

(52) U.S. Cl.
CPC ..... *B41J 2/1433* (2013.01); *B41J 2/14201* (2013.01); *B41J 2/14209* (2013.01); *B41J 2/162* (2013.01); *B41J 2/1607* (2013.01); *B41J 2/1609* (2013.01); *B41J 2/1623* (2013.01); *B41J 2/1632* (2013.01); *B41J 2/1635* (2013.01)

(58) Field of Classification Search
CPC .... B41J 2/1433; B41J 2/1607; B41J 2/14201; B41J 2/162; B41J 2/1632
USPC ..... 347/20, 40, 44, 47, 68
See application file for complete search history.

(56) References Cited

FOREIGN PATENT DOCUMENTS

| | | |
|---|---|---|
| GB | 2 497 869 A | 6/2013 |
| GB | 2 498 094 A | 7/2013 |
| WO | WO 98/42514 A1 | 10/1998 |

OTHER PUBLICATIONS

Extended Search Report in European Application No. 17194006.7, dated Feb. 22, 2018, 7 pages.

*Primary Examiner* — An Do
(74) *Attorney, Agent, or Firm* — Brinks Gilson & Lione

(57) ABSTRACT

A liquid ejection head includes: actuator plates having discharge channels to be filled with an ink; sub-plates stacked on the −Z-direction end surfaces of discharge channels in the actuator plates along a flow direction of the ink and having communication paths communicating with the discharge channels; and a nozzle plate stacked on the −Z-direction end surfaces of the communication paths in the sub-plates along the flow direction and having nozzle holes communicating with the discharge channels through the communication paths. The −Z-direction end surfaces of the sub-plates are polished.

6 Claims, 7 Drawing Sheets

LIQUID EJECTION HEAD, METHOD FOR MANUFACTURING LIQUID EJECTION HEAD, LIQUID EJECTION APPARATUS

RELATED APPLICATIONS

This application claims priority under 35 U.S.C. § 119 to Japanese Patent Application No. 2016-191715 filed on Sep. 29, 2016, the entire content of which is hereby incorporated by reference.

BACKGROUND OF THE INVENTION

Technical Field

The present invention relates to a liquid ejection head, a method for manufacturing the liquid ejection head, and a liquid ejection apparatus.

Related Art

There is an inkjet printer including an inkjet head as an apparatus that discharges ink droplets onto a recording medium (for example, recording paper or the like) so as to record information on the recording medium (for example, images, characters, and the like).

The inkjet head includes a head chip having a channel filled with an ink and a nozzle plate bonded to the head chip and having nozzle holes communicating with a channel. In the inkjet head, the volume of the channel increases and decreases to discharge the ink charged in the channel through the nozzle holes.

In addition, a configuration of an inkjet head in which a plurality of head chips is collectively bonded to enable high-resolution printing, high-speed printing, and others is disclosed (see for example, WO 98/42514).

SUMMARY OF THE INVENTION

However, in the inkjet head described above, the surfaces of the head chips bonded to the nozzle plate may suffer warping or the like due to the influence of heat applied at the time of manufacture of the head chips, for example. In this case, it is difficult to smooth the bonding surfaces of the head chips, and the bonding surfaces of the head chips becomes wavy with convexes and concaves, for example. When the nozzle plate is bonded to the bonding surfaces of the head chips with convexes and concaves, the nozzle plate may get lifted or separated.

In particular, there has been recently studied, in a configuration in which a plurality of head chips is stacked as described in WO 98/42514, a single nozzle plate bonded at a time to the head chips. However, when the bonding surfaces of the head chips are concave-convex, it is difficult to let the nozzle plate follow the bonding surfaces of the head chips, which may lead to occurrence of the lift and separation as described above in a more prominent manner.

The present invention is devised in light of the foregoing circumstances. An object of the present invention is to provide a liquid ejection head, a method for manufacturing the liquid ejection head, and a liquid ejection apparatus that suppress the lift and separation of the nozzle plate.

To achieve the foregoing object, a liquid ejection head according to an aspect of the present invention includes: an actuator plate having a channel to be filled with a liquid; a sub-plate stacked on a downstream opening surface of the channel in a flow direction of the liquid in the actuator plate and having a communication path communicating with the channel; and an ejection hole plate stacked on a downstream opening surface of the communication path in the flow direction in the sub-plate and having an ejection hole communicating with the channel through the communication path, in which the downstream opening surface of the sub-plate is polished.

According to this configuration, the downstream opening surfaces of sub-plates are polished to make smooth the surface of the sub-plate on which the ejection hole plate is stacked. Accordingly, the ejection hole plate can be reliably stacked on the sub-plate to suppress the lift and separation of the ejection hole plate over a long period of time.

In this aspect, particularly, the sub-plate between the ejection hole plate and the actuator plate are polished and thus a drive electrode formed on the inner surface of the channel are not polished unlike in the case in which the actuator plate is polished. This improves the processability in the polishing process. In addition, it is possible to suppress variations in pump length among the individual actuator plates (the length of the channel with the drive electrode). As a result, it is possible to suppress fluctuations in discharge performance (frequency characteristics and the like) among the individual actuator plates.

Further, in this aspect, the drive electrode is not polished as described above, and the sub-plate can be re-polished. That is, even though the ejection hole plate is bonded in an improper manner, the sub-plate is re-polished to remove the adhesive from the sub-plate so that the ejection hole plate can be re-stacked. This improves the yield of the liquid ejection head.

In the foregoing aspect, the actuator plate and the sub-plate may constitute a chip module, a plurality of the chip modules may be aligned, and the ejection hole plate may be bonded at a time to the downstream opening surfaces of the sub-plates in the plurality of chip modules.

According to the foregoing aspect, bonding one ejection hole plate to the chip modules makes it possible to suppress fluctuations in the relative positions of the ejection holes as compared to the case in which separate ejection hole plates are bonded to the chip modules.

In this aspect, particularly, the downstream opening surfaces of the sub-plates are polished and thus the downstream opening surfaces of the chip modules can be smoothed. Accordingly, the ejection hole plate can be reliably bonded to the plurality of chip modules to suppress the lift and separation of the ejection hole plate over a long period of time.

In the foregoing aspect, the channel may be supplied with the liquid from a liquid supply source, and the sub-plate may allow the communication path to communicate with the channel and the ejection hole and constitute a return plate with a return path in which the liquid is flowed to the liquid supply source.

According to the foregoing aspect, using the sub-plate as a return plate makes it possible to decrease the number of components and improve the manufacturing efficiency as compared to the case in which a return plate is provided separately from the sub-plate.

In the foregoing aspect, part of the liquid flowed in the return path may be flowed to a circulation path communicating with the liquid supply source, and a flow path cross-section area of a portion of the return path positioned nearer the circulation path than the portion of the return path communicating with the ejection hole may be equal to or smaller than a flow path cross-section area orthogonal to the flow direction at the downstream opening surface of the channel.

According to the foregoing aspect, the pressure wave generated in the liquid in the channel at the time of liquid ejection can be reliably propagated to the ejection hole. Accordingly, the liquid can be reliably ejected from the ejection hole according to the driving of the channel.

In the foregoing aspect, the actuator plate and the sub-plate may be formed from the same material.

According to the foregoing aspect, it is possible to relieve the stress acting on the actuator plate and the sub-plate resulting from the difference in thermal expansion coefficient between the actuator plate and the sub-plate. This suppresses the separation of the actuator plate and the sub-plate.

A liquid ejection apparatus according to an aspect of the present invention includes the liquid ejection head according to the foregoing aspect.

According to the foregoing aspect, including the liquid ejection head makes it possible to provide a high-quality liquid ejection apparatus with excellent reliability over a long period of time.

A method for manufacturing a liquid ejection head according to an aspect of the present invention includes: an actuator plate having a channel to be filled with a liquid; and a sub-plate stacked on a downstream opening surface of the channel in a flow direction of liquid in the actuator plate and having a communication path communicating with the channel, in which the method includes: a polishing step of polishing a downstream opening surface of the communication path in the sub-plate along the flow direction; and a stacking step of stacking an ejection hole plate having an ejection hole communicating with the channel through the communication path on the downstream opening surface of the sub-plate.

According to this configuration, polishing the downstream opening surface of the sub-plate makes smooth the surface of the sub-plate on which the ejection hole plate is stacked. This allows the ejection hole plate to be reliably stacked on the sub-plate and suppresses the lift and separation of the ejection hole plate over a long period of time.

In the foregoing aspect, the actuator plate and the sub-plate may constitute a chip module, in the polishing step, the downstream opening surfaces of the sub-plates in a plurality of the chip modules may be collectively polished, and in the stacking step, the ejection hole plate may be stacked at a time to the downstream opening surfaces of the sub-plates in the plurality of chip modules.

According to this aspect, the plurality of chip modules is collectively polished in the polishing process to suppress variations in the position and shape of the downstream opening surfaces of the sub-plates in the chip modules. That is, the downstream opening surfaces of the sub-plates can be flush with one another and the ejection hole plate can be reliably stacked on the chip modules.

According to one aspect of the present invention, it is possible to suppress the lift and separation of the ejection hole plate.

DETAILED DESCRIPTION OF THE PREFERRED EMBODIMENTS

Figure 1:
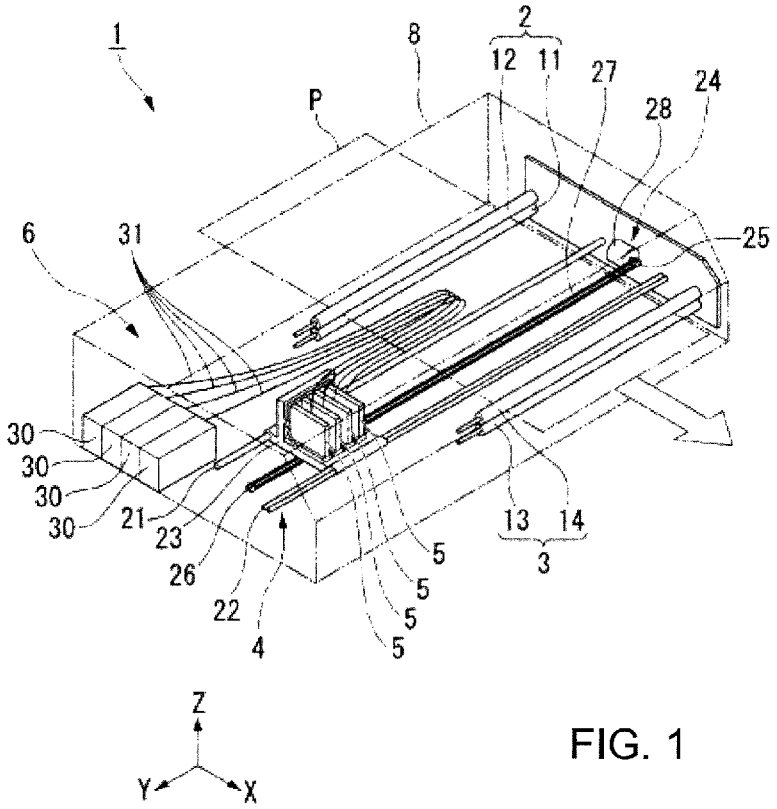
FIG. 1 is a schematic configuration diagram of an inkjet printer according to a first embodiment.

Embodiments of the present invention will be described below with reference to the drawings. In the following description of the embodiments, an inkjet printer (hereinafter, simply called printer) for making records on a recording medium using an ink (liquid) will be taken as an example. In the drawings used in the following description, the members are scaled as appropriate so that the members can be illustrated in recognizable sizes.

First Embodiment

[Printer]

FIG. 1 is a schematic configuration diagram of a printer 1 according to a first embodiment.

As illustrated in FIG. 1, the printer 1 of the embodiment is configured in such a manner that a pair of conveying mechanisms 2 and 3, a scanning mechanism 4, inkjet heads 5, an ink supply mechanism 6, and others are stored in a housing 8. In the following description, an orthogonal coordinate system of X, Y, and Z is used as necessary. In this case, an X direction is aligned to the direction in which a recording medium P (for example, paper or the like) is conveyed, a Y direction is aligned to the direction in which the scanning mechanism 4 scans, and a Z direction is orthogonal to the X direction and the Y direction. In the following description, the X direction, the Y direction, and the Z direction are illustrated as plus (+) directions along arrows in the drawings and minus (−) directions opposite to the arrows.

The conveying mechanisms 2 and 3 convey the recording medium P in the X direction. Specifically, the conveying mechanism 2 includes a grit roller 11 extended in the Y direction, a pinch roller 12 extended in parallel to the grit roller 11, and a driving mechanism (not illustrated) such as a motor for axially rotating the grit roller 11. The conveying mechanism 3 includes a grit roller 13 extended in the Y direction, a pinch roller 14 extended in parallel to the grit roller 13, and a driving mechanism (not illustrated) for axially rotating the grit roller 13.

The scanning mechanism 4 reciprocates the inkjet heads 5 for scanning in the Y direction. Specifically, the scanning mechanism 4 includes a pair of guide rails 21 and 22 extended in the Y direction, a carriage 23 movably supported by the pair of guide rails 21 and 22, and a driving mechanism 24 moving the carriage 23 in the Y direction.

The driving mechanism 24 is interposed between the guide rails 21 and 22 in the X direction. The driving mechanism 24 includes a pair of pulleys 25 and 26 spaced in the Y direction, an endless belt 27 wound around the pair of pulleys 25 and 26, and a driving motor 28 rotationally driving the pulley 25.

The carriage 23 is coupled to the endless belt 27. The carriage 23 is loaded with the plurality of inkjet heads 5 aligned in the Y direction.

The inkjet heads 5 are configured to discharge inks of different colors such as yellow, magenta, cyan, and black, for example.

The ink supply mechanism 6 includes a plurality of ink tanks 30 storing inks and ink tubes 31 connecting the ink tanks 30 and the inkjet heads 5.

The ink tanks 30 are provided separately from the inkjet heads 5 (carriage 23) in the housing 8. The ink tanks 30 are aligned in the X direction in the housing 8. The ink tanks 30 store inks of different colors corresponding to the inkjet heads 5.

The ink tubes 31 are flexible hoses, for example. The ink tubes 31 can follow the inkjet heads 5.

<Inkjet Head>

Figure 2:
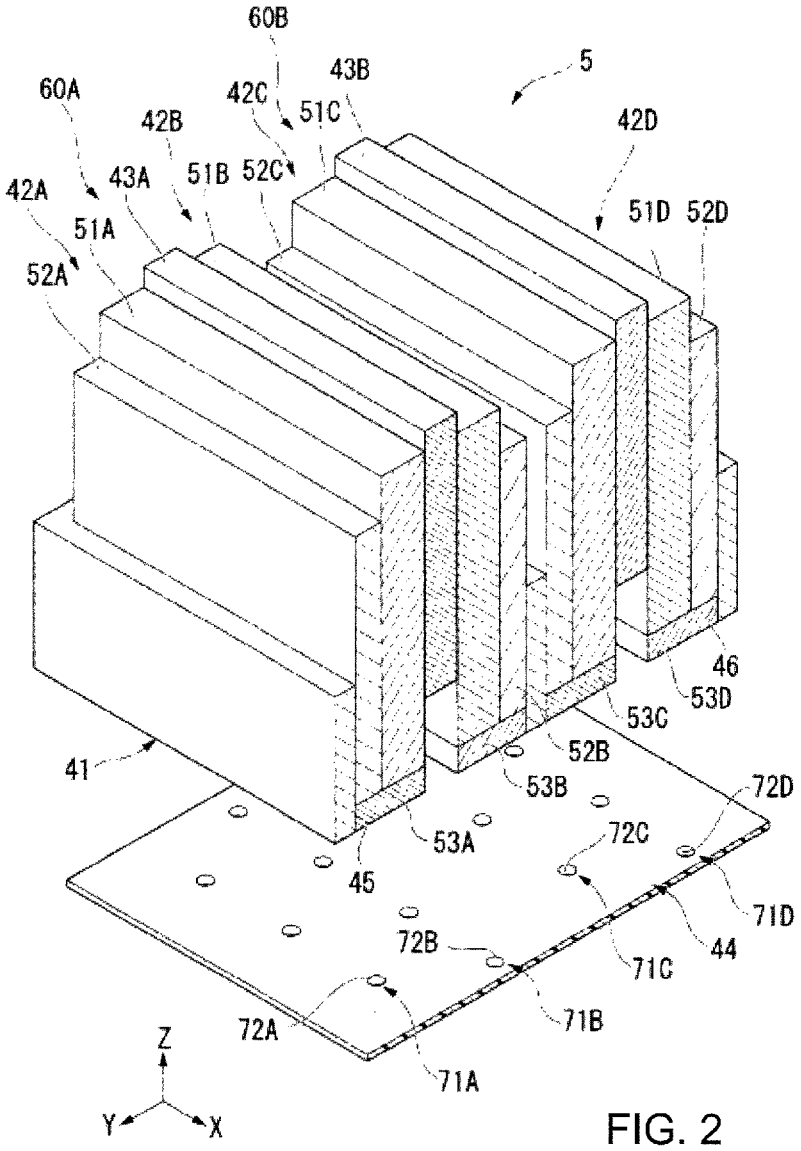
FIG. 2 is a schematic perspective view of an inkjet head according to the first embodiment.

FIG. 2 is a schematic perspective view of the inkjet head 5. The inkjet heads 5 are all the same in configuration except for the colors of the supplied inks. Accordingly, in the following description, one inkjet head 5 will be taken as an example and descriptions of the other inkjet heads 5 will be omitted.

As illustrated in FIG. 2, the inkjet head 5 is an edge shoot type that discharges an ink from leading ends (−Z-direction ends) of discharge channels 55 described later (see FIG. 3) along the extending direction. Specifically, the inkjet head 5 mainly includes a base member 41, a plurality of head chips 42A to 42D, spacer plates 43A and 43B, and a nozzle plate 44.

<Base Member>

The base member 41 is formed in a plate shape with a thickness side along the Z direction and a longitudinal side along the X direction. The base member 41 has attachment openings 45 and 46 penetrating through the base member 41 in the Z direction. In the embodiment, the attachment openings 45 and 46 are spaced in two lines in the Y direction. The base member 41 is loaded with a damper, a control substrate, various flow path members, and others not illustrated as well as the head chips 42A to 42D and the nozzle plate 44. For example, the damper is arranged in the +Z direction (the upstream side of the direction of ink flow) beyond the head chips 42A to 42D, thereby to absorb fluctuations in the pressure of the ink supplied from the ink tank 30. However, the configuration of the base member 41 can be changed as appropriate.

<Head Chips>

The head chips 42A to 42D are configured to discharge the ink supplied from the ink tank 30 onto the recording medium P. In the embodiment, the four head chips (the first head chip 42A, the second head chip 42B, the third head chip 42C, and the fourth head chip 42D) are aligned in the base member 41 in the Y direction.

Figure 3:
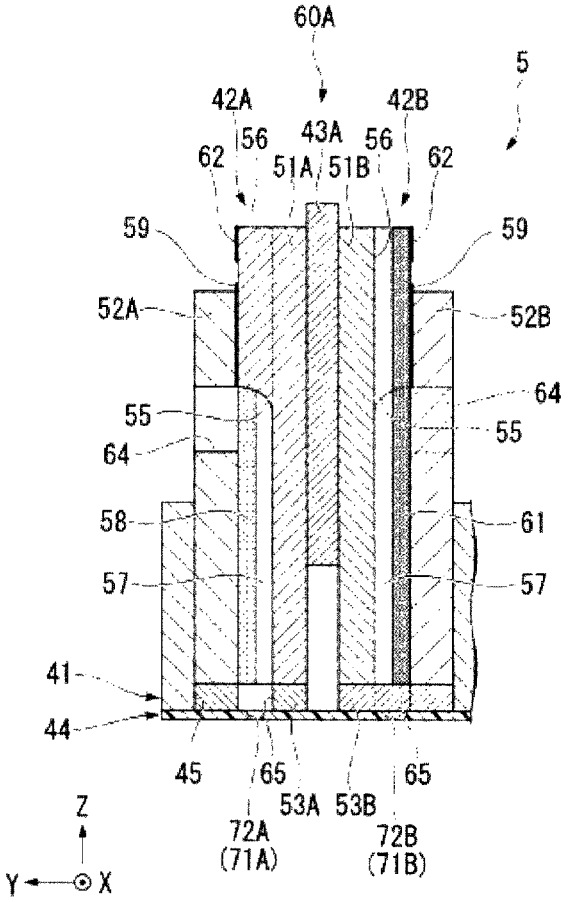
FIG. 3 is an enlarged cross-section view of a first chip module in the inkjet head according to the first embodiment.

FIG. 3 is an enlarged cross-section view of a first chip module 60A in the inkjet head 5.

As illustrated in FIG. 3, the first head chip 42A includes a first actuator plate 51A, a first cover plate 52A, and a first sub-plate 53A.

The first actuator plate 51A is formed from a piezoelectric material such as lead zirconate titanate (PZT). The direction of polarization of the first actuator plate 51A is set to one along the thickness direction (Y direction). Alternatively, the first actuator plate 51A may be formed by stacking two piezoelectric substrates different in the direction of polarization in the Y direction (chevron type).

The first actuator plate 51A has a plurality of channels 55 and 56 aligned in parallel with a space left in the X direction on the +Y-direction end surface. The channels 55 and 56 are linearly formed along the Z direction. The channels 55 are discharge channels 55 to be filled with an ink (channels to be filled with a liquid), and the channels 56 are non-discharge channels 56 not to be filled with an ink. The portion of the first actuator plate 51A positioned between the channels 55 and 56 constitutes a drive wall 57 that divides the channels 55 and 56 in the X direction.

The discharge channels 55 have +Z-direction ends terminated in the actuator plate 51A and −Z-direction ends opened in the −Z-direction end surface (downstream opening surface) of the actuator plate 51A.

The non-discharge channels 56 are formed with a uniform Y-direction groove depth on the whole along the Z direction. The non-discharge channels 56 penetrate through the actuator plate 51A in the Z direction.

The discharge channels 55 have a common electrode 58 on the inner surface. The common electrode 58 has a Y-direction width in the discharge channels 55 that is about half the width of the discharge channels 55. The common electrode 58 is formed on the inner surfaces of the discharge channels 55 ranging from the +Y-direction end edge to the Y-direction center. The first actuator plate 51A has a common wire 59 formed on the +Y-direction end surface at a position along the +Z direction with respect to the discharge channels 55. The common wire 59 is belt-shaped and extended in the Z direction. The common wire 59 has a −Z-direction end connected to the common electrode 58 and a +Z-direction end terminated on the +Y-direction end surface of the first actuator plate.

The non-discharge channels 56 have individual electrodes 61 on the inner surface (see individual electrodes 61 on the second head chip 42B). The individual electrodes 61 are individually formed on the internal side surfaces of the non-discharge channels 56 opposed in the Y direction. The individual electrodes 61 have a Y-direction width that is about half the width of the non-discharge channels 56. The individual electrodes 61 are formed on the internal side surfaces of the non-discharge channels 56 opposed in the X direction ranging from the +Y-direction end edge to the intermediate portion. In this case, of the individual electrodes 61, the individual electrodes 61 opposed to each other in the same non-discharge channel 56 are electrically separated from each other.

The first actuator plate 51A has individual wires 62 on the +Y-direction end surface at positions along the +Z direction beyond the common wire 59. The individual wires 62 are belt-shaped and extended in the X direction. The individual wires 62 electrically connect the individual electrodes 61 adjacent to each other with the discharge channels 55 therebetween.

The first cover plate 52A is bonded to the +Y-direction end surface of the first actuator plate 51A such that the +Z-direction end of the first actuator plate 51A projects. A flexible substrate not illustrated is mounted on the +Z-direction end of the first actuator plate 51A (the portion projecting beyond the first cover plate 52A) to connect the common wire 59 and the individual wires 62 to a control substrate not illustrated. The first cover plate 52A is preferably formed from the same material as that of the first actuator plate 51A.

The first cover plate 52A has slits 64 at positions overlapping the +Z-direction ends of the discharge channels 55 seen from the Y direction, respectively. The slits 64 penetrate through the first cover plate 52A in the Y direction to communicate with the corresponding discharge channels 55. The ink in the ink tank (liquid supply source) 30 is flowed in the ink tube 31 and supplied to the inkjet head 5. The ink supplied to the inkjet head 5 is flowed in the damper and the flow path members described above, and then is supplied to the discharge channels 55 through the slits 64.

The first sub-plate 53A is bonded at a time to the −Z-direction end surfaces of the first actuator plate 51A and the first cover plate 52A. The first sub-plate 53A is formed from the same material (piezoelectric material such as PZT) as that of the first actuator plate 51A. Communication paths 65 are formed in the first sub-plate 53A at positions overlapping the discharge channels 55 seen from the Z direction. The communication paths 65 penetrate through the first sub-plate 53A in the Z direction to individually communicate with the corresponding discharge channels 55.

The first sub-plate 53A has a Z-direction thickness that is equal to or less than the Y-direction depth of the discharge channels 55 (for example, about 100 μm). The −Z-direction end surface (downstream opening surface) of the first sub-plate 53A is polished in a polishing process described later. Therefore, the −Z-direction end surface of the first sub-plate 53A is smoothed on the whole. In the embodiment, the "smooth surface" means that at least the entire portion to be bonded to the nozzle plate 44 needs to be smooth but the normal to the smooth surface may not align with the Z direction (the normal to the smooth surface may cross with the Z direction). The first sub-plate 53A can be formed from various materials other than a piezoelectric material. In this case, the first sub-plate 53A can be formed from non-doped silicon or the like, for example. Besides, the first sub-plate 53A can be formed from one selected as appropriate from among materials with small differences in thermal expansion coefficient from the first actuator plate 51A, materials excellent in processability in the polishing process, insulating materials, and others.

The second head chip 42B includes a second actuator plate 51B, a second cover plate 52B, and a second sub-plate 53B. In the following description, the same components of the second head chip 42B as those of the first head chip 42A will be given the same reference signs as those of the first head chip 42A, and descriptions thereof will be omitted.

The first head chip 42A and the second head chip 42B are opposed to each other with the first spacer plate 43A therebetween. Specifically, the first head chip 42A has the −Y-direction end surface of the first actuator plate 51A bonded to the +Y-direction end surface of the first spacer plate 43A. The second head chip 42B has the +Y-direction end surface of the second actuator plate 51B bonded to the −Y-direction end surface of the first spacer plate 43A. The first head chip 42A, the second head chip 42B, and the first spacer plate 43A are bonded together to constitute the first chip module 60A. The first chip module 60A is inserted into the first attachment opening 45 of the base member 41. In the illustrated example, the −Z-direction end surface of the first spacer plate 43A is positioned in the +Z direction beyond the +Z-direction end surfaces of the sub-plates 53A and 53B.

The discharge channels 55 and the non-discharge channels 56 in the second head chip 42B are arranged at a pitch shifted from the pitch of the discharge channels 55 and the non-discharge channels 56 in the first head chip 42A. That is, the discharge channels 55 and the non-discharge channels 56 in the head chips 42A and 42B are arranged in a staggered pattern. In this case, the discharge channels 55 in the first head chip 42A and the non-discharge channels 56 in the second head chip 42B are opposed to each other in the Y direction, and the non-discharge channels 56 in the first head chip 42A and the discharge channels 55 in the second head chip 42B are opposed to each other in the Y direction.

As illustrated in FIG. 2, the third head chip 42C and the fourth head chip 42D are configured in the same manner as the first head chip 42A and the second head chip 42B. That is, the third head chip 42C includes a third actuator plate 51C, a third cover plate 52C, and a third sub-plate 53C.

The fourth head chip 42D includes a fourth actuator plate 51D, a fourth cover plate 52D, and a fourth sub-plate 53D.

The third head chip 42C and the fourth head chip 42D are bonded to the second spacer plate 43B and opposed to each other in the Y direction with the second spacer plate 43B therebetween. The third head chip 42C, the fourth head chip 42D, and the second spacer plate 43B are bonded together to constitute a second chip module 60B. The second chip module 60B is inserted into the second attachment opening 46 of the base member 41. In the embodiment, the −Z-direction end surfaces of the base member 41, the first chip module 60A, and the second chip module 60B are flush with one another.

The discharge channels 55 and the non-discharge channels 56 in the third head chip 42C are shifted ¼ pitch from the discharge channels 55 and the non-discharge channels 56 in the first head chip 42A, respectively. The discharge channels 55 and the non-discharge channels 56 in the fourth head chip 42D are shifted ¼ pitch from the discharge channels 55 and the non-discharge channels 56 in the second head chip 42B, respectively. Therefore, the discharge channels 55 and the non-discharge channels 56 in the head chips 42A to 42D are shifted ¼ pitch from each other. However, the pitch of the discharge channels 55 and the non-discharge channels 56 can be changed as appropriate among the head chips 42A to 42D. That is, the discharge channels 55 and the non-discharge channels 56 may be formed at positions equal in the X direction or positions different in the X direction among the head chips 42A to 42D.

<Nozzle Plate>

The nozzle plate 44 is formed from a resin material such as polyimide. The nozzle plate 44 is bonded at a time to the −Z-direction end surfaces of the chip modules 60A and 60B and the base member 41. The nozzle plate 44 is not necessarily formed from a resin material but may be formed from a metallic material (stainless steel or the like). Alternatively, the nozzle plate 44 may have a stacked structure of a resin material and a metallic material.

The nozzle plate 44 has a plurality of nozzle lines (a first nozzle line 71A to a fourth nozzle line 71D) extending in the X direction and spaced in the Y direction. The nozzle lines 71A to 71D are formed in the nozzle plate 44 at respective positions opposed to the corresponding to head chips 42A to 42D in the Z direction.

The nozzle lines 71A to 71D have respective nozzle holes (first nozzle holes 72A to fourth nozzle holes 72D) penetrating through the nozzle plate 44 in the Z direction. For example, the first nozzle holes (ejection holes) 72A are individually formed in the nozzle plate 44 at positions opposed to the discharge channels 55 in the first head chip 42A in the Z direction. That is, the plurality of first nozzle holes 72A is linearly aligned at spaces left in the X direction to form the first nozzle line 71A. In addition, the first nozzle holes 72A communicate with the discharge channels 55 in the first head chip 42A through communication paths 65 formed in the first sub-plate 53A.

As with the first nozzle holes 72A, the second nozzle holes 72B, the third nozzle holes 72C, and the fourth nozzle holes 72D are individually formed in the nozzle plate 44 at positions opposed to the discharge channels 55 in the corresponding head chips 42B to 42D in the Z direction. The nozzle holes 72B to 72D communicate with the discharge channels 55 in the corresponding head chips 42B to 42D through the communication paths 65 in the corresponding sub-plates 53B to 53D.

[Method for Operating Printer]

Next, the use of the printer 1 configured as described above for recording characters, graphics, and others on the recording medium P will be described below.

When the printer 1 is operated, the grit rollers 11 and 13 in the conveying mechanisms 2 and 3 rotate to convey the recording medium P in the X direction between the grit rollers 11 and 13 and the pinch rollers 12 and 14. At the same time, the driving motor 28 rotates the pulley 25 to run the endless belt 27. Accordingly, the carriage 23 reciprocates in the Y direction while being guided by the guide rails 21 and 22.

In the meantime, the inkjet heads 5 discharge as appropriate inks of four colors onto the recording medium P to record characters, images, and others.

The operations of the inkjet head 5 will be described below in detail. The following description is based on the assumption that the nozzle holes 72A to 72D have proper menisci.

As illustrated in FIG. 3, the inkjet head 5 applies a driving voltage between the electrodes 58 and 61. Accordingly, the two drive walls 57 defining the discharge channels 55 undergo thickness slip deformation. The two drive walls 57 deform and bulge the discharge channels 55 toward the non-discharge channels 56. The actuator plates 51A to 51D of the embodiment have one direction of polarization, and the electrodes 58 and 61 are only formed up to central portions of the drive walls 57 in the Y direction. Accordingly, applying a voltage between the electrodes 58 and 61 causes the Y-direction central portions of the drive walls 57 to bend and deform in a V shape. This allows the discharge channels 55 to deform as if they bulge.

The deformation caused by the piezoelectric thickness slip of the two drive walls 57 increases the volumes of the discharge channels 55. With the increase in the volumes of the discharge channels 55, the ink in the slits 64 is guided into the discharge channels 55. The ink guided into the discharge channels 55 propagates as a pressure wave into the inside of the discharge channel 55. When reaching the nozzle holes 72A to 72D, the pressure wave turns the voltage applied between the electrodes 58 and 61 into zero. Accordingly, the drive walls 57 are restored to return the temporarily increased volumes of the discharge channels 55 to the original ones. By this operation, the pressure in the discharge channels 55 increases to pressurize the ink. As a result, the ink droplets are discharged to the outside through the nozzle holes 72A to 72D to record characters, images, and others on the recording medium P as described above.

[Method for Manufacturing Inkjet Head]

Next, a method for manufacturing the inkjet head 5 will be described.

The method for manufacturing the inkjet head 5 of the embodiment includes mainly a chip production process, a chip bonding process, a polishing process, and a head assembly process. In the following description, the chip production process will be explained taking the first head chip 42A as an example.

<Chip Production Process>

The chip production process includes mainly an actuator plate production step, a cover plate production step, a sub-plate production step, and a plate bonding step.

At the actuator plate production step, dicing lines to be later the discharge channels 55 and the non-discharge channels 56 are formed in an actuator wafer (not illustrated) as a mother material for the first actuator plate 51A. The dicing lines can be formed by cutting with a dicing blade.

Subsequently, drive electrodes to be later the common electrode 58, the individual electrodes 61, the common wire 59, and the individual wires 62 are formed on the actuator wafer. Specifically, the drive electrodes are formed by performing oblique deposition or the like on the actuator wafer through a mask not illustrated.

After that, the actuator wafer is cut with a dicing blade or the like and divided into individual first actuator plates 51A.

Accordingly, the first actuator plate 51A is completed.

In the cover plate production step, the slits 64 are formed in a cover wafer as a mother material for the first cover plate 52A. The slits 64 are formed by performing sand blasting or the like through a mask not illustrated. After that, the cover wafer is cut with a dicing blade or the like and divided into individual first cover plates 52A.

Accordingly, the first cover plate 52A is completed.

In the sub-plate production step, first, the communication paths 65 are formed in a sub-plate wafer (not illustrated) as a mother material for the first sub-plate 53A. The communication paths 65 are formed by performing sand blasting the like with a mask not illustrated. After that, the sub-plate wafer is divided into individual pieces, whereby the first sub-plate 53A is completed.

In the plate bonding step, the first actuator plate 51A, the first cover plate 52A, and the first sub-plate 53A are bonded together with an adhesive. Accordingly, the first head chip 42A is completed. The first head chip 42A may be formed by bonding together the actuator wafer and the cover wafer, dividing collectively the actuator wafer and the cover wafer into individual pieces, and then bonding the first sub-plate 53A to each of the pieces. The second head chip 42B, the third head chip 42C, and the fourth head chip 42D can be formed in the same process as the chip production process described above.

<Chip Bonding Process>

Figure 4:
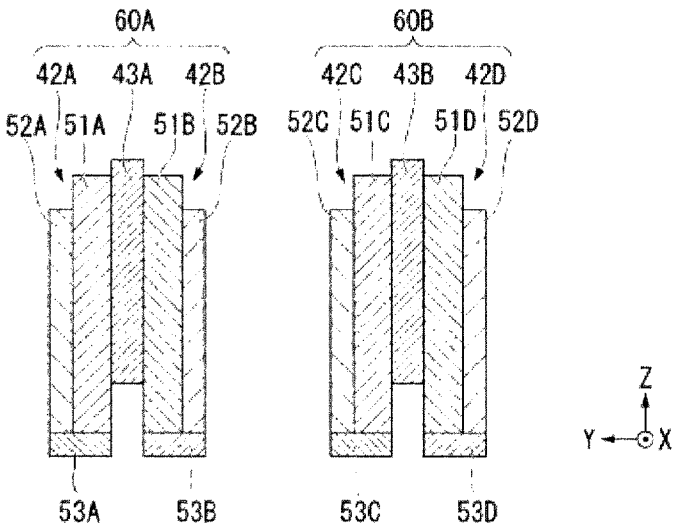
FIG. 4 is a process diagram of a chip bonding process.
Figure 5:
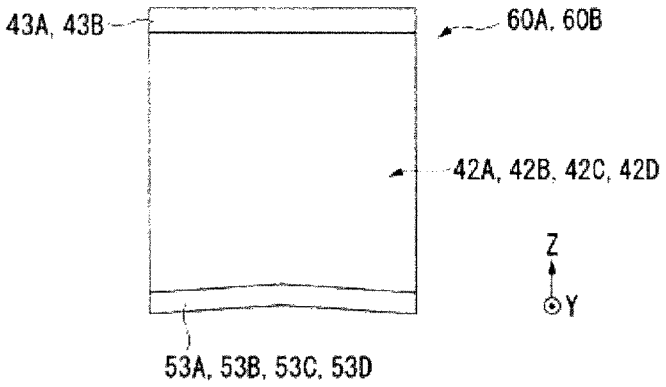
FIG. 5 is a process diagram of the chip bonding process.

FIG. 4 is a process diagram of the chip bonding process and is a cross-sectional view of the chip modules 60A and 60B seen from the X direction. FIG. 5 is a process diagram of the chip bonding process and is a side view of the chip modules 60A and 60B seen from the Y direction.

As illustrated in FIGS. 4 and 5, in the chip bonding process, the head chips formed in the chip production process are bonded together with a spacer plate therebetween. Specifically, the first head chip 42A and the second head chip 42B are bonded to the first spacer plate 43A, and the third head chip 42C and the fourth head chip 42D are bonded to the second spacer plate 43B. Accordingly, the first chip module 60A and the second chip module 60B are formed.

As illustrated in FIG. 5, the −Z-direction end surfaces of the head chips 42A to 42D (actuator plates 51A to 51D) may be convex-concave surfaces due to a warp resulting from the application of heat or the like at the formation of the drive electrodes or processing variations at the time of dividing the wafers into individual pieces. In this case, in the plate bonding process, the sub-plates 53A to 53D are bonded in such a manner as to follow the −Z-direction end surfaces of the head chips 42A to 42D, which may turn the −Z-direction end surfaces of the sub-plates 53A to 53D into convex-concave surfaces as well.

<Polishing Process>

Figure 6:
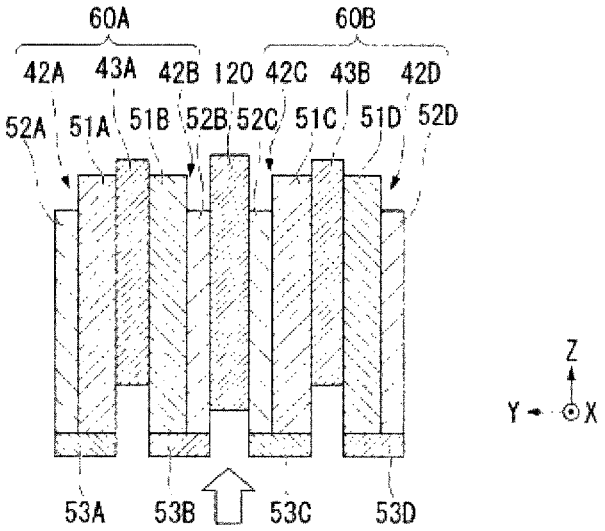
FIG. 6 is a process diagram of a polishing process.

FIG. 6 is a process diagram of the polishing process and is a cross-section view of the chip modules 60A and 60B seen from the X direction.

As illustrate in FIG. 6, in the embodiment, the −Z-direction end surfaces of the chip modules 60A and 60B are collectively polished in the polishing process. Specifically, first, a spacer 120 is sandwiched between the chip modules 60A and 60B, and then the chip modules 60A and 60B and the spacer 120 are collectively held by a jig (not illustrated). At that time, the −Z-direction end surfaces of the sub-plates 53A to 53D in the chip modules 60A and 60B are preferably held by the jig in such a manner as to arrange at positions equal in the Z direction.

Figure 7:
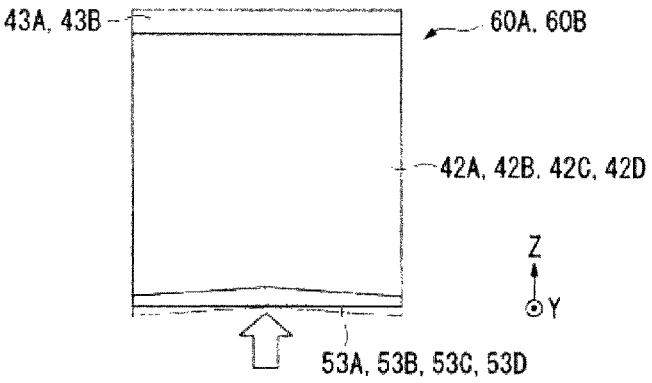
FIG. 7 is a process diagram of the polishing process.

Subsequently, while the chip modules 60A and 60B are held, the −Z-direction end surfaces of the sub-plates 53A to 53D are polished by a polishing device such as a grinder. Specifically, as illustrated in FIGS. 6 and 7, the −Z-direction end surfaces of the sub-plates 53A to 53D are pressed against the polishing device to polish the −Z-direction end surfaces of the sub-plates 53A to 53D such that the −Z-direction end surfaces of the sub-plates 53A to 53D are flush with one another (surfacing). The amount of polishing the sub-plates 53A to 53D can be set as appropriate depending on the status of the −Z-direction end surfaces of the sub-plates 53A to 53D. In this case, as far as the −Z-direction end surfaces of the sub-plates 53A to 53D are flush with one another, the chip modules 60A and 60B may be different in length in the Z direction after the polishing process. In addition, the chip modules 60A and 60B may be polished separately in the polishing process.

<Head Assembly Process>

Figure 8:
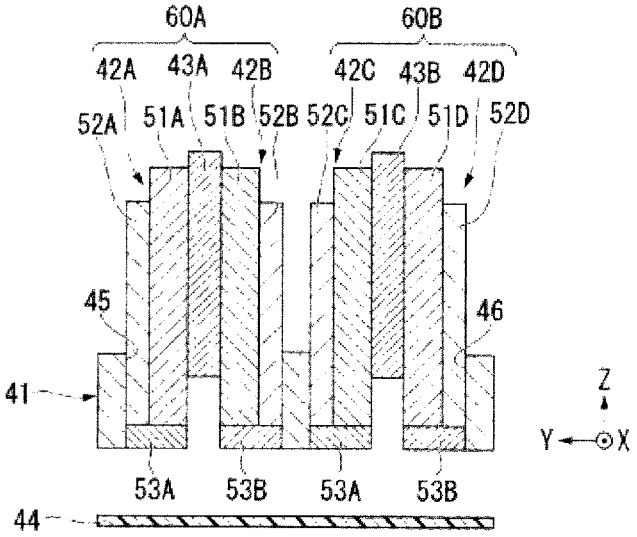
FIG. 8 is a process diagram of a head assembly process.

FIG. 8 is a process diagram of the head assembly process.

As illustrated in FIG. 8, in the head assembly process, the chip modules 60A and 60B are assembled into the base member 41. Specifically, the first chip module 60A is inserted into the first attachment opening 45 of the base member 41. In addition, the second chip module 60B is inserted into the second attachment opening 46 of the base member 41. At that time, the first chip module 60A and the second chip module 60B are arrange such that the −Z-direction end surfaces of the chip modules 60A and 60B and the −Z-direction end surface of the base member 41 are flush with one another.

Subsequently, the nozzle plate 44 is entirely bonded to the −Z-direction end surfaces of the chip modules 60A and 60B and the −Z-direction end surface of the base member 41 by an adhesive or the like (stacking step). At that time, the nozzle plate 44 is bonded such that the nozzle holes 72A to 72D in the nozzle plate 44 communicate with the corresponding discharge channels 55 (communication paths 65) in the head chips 42A to 42D.

Accordingly, the inkjet head 5 is completed.

In the embodiment as described above, the nozzle plate 44 is bonded to the polished −Z-direction end surfaces of the sub-plates 53A to 53D.

According to this configuration, polishing the −Z-direction end surfaces of the sub-plates 53A to 53D makes smooth the bonding surfaces of the chip modules 60A and 60B to the nozzle plate 44. Accordingly, the nozzle plate 44 can be reliably bonded to the chip modules 60A and 60B to suppress the lift and separation of the nozzle plate 44 over a long period of time.

In particular, in the embodiment, the sub-plates 53A to 53D between the nozzle plate 44 and the actuator plates 51A to 51D are polished and thus the drive electrodes (common electrode 58 and individual electrodes 61) are not polished unlike in the case in which the actuator plates 51A to 51D are polished. This improves the processability in the polishing process. In addition, it is possible to suppress variations in pump length among the actuator plates 51A to 51D in the head chips 42A to 42D (the Z-direction lengths of the portions of the discharge channels 55 with the drive electrodes). As a result, it is possible to suppress fluctuations in discharge performance (frequency characteristics and the like) among the head chips 42A to 42D.

Further, the drive electrodes are not polished as described above, and the sub-plates 53A to 53D can be re-polished. That is, even though the nozzle plate 44 is bonded in an improper manner, the sub-plates 53A to 53D are re-polished to remove the adhesive from the sub-plates 53A to 53D so that the nozzle plate 44 can be re-bonded. This improves the yield of the inkjet head 5.

In the embodiment, the nozzle plate 44 is bonded at a time to the −Z-direction end surfaces of the plurality of chip modules 60A and 60B (sub-plates 53A to 53D).

According to this configuration, the one nozzle plate 44 is bonded to the chip modules 60A and 60B. This reduces variations in the relative positions of the nozzle lines 71A to 71D as compared to the case of bonding separate nozzle plates 44 to the chip modules 60A and 60B.

In particular, in the embodiment, the −Z-direction end surfaces of the sub-plates 53A to 53D are polished to make smooth the −Z-direction end surfaces of the chip modules 60A and 60B. Accordingly, the nozzle plate 44 can be reliably bonded to the plurality of chip modules 60A and 60B to suppress the lift and separation of the nozzle plate 44 over a long period of time.

In the embodiment, in the polishing process, the chip modules 60A and 60B are collectively polished to suppress variations in position and shape between the −Z-direction end surfaces of the chip modules 60A and 60B. That is, the −Z-direction end surfaces of the chip modules 60A and 60B can be flush with each other to allow the nozzle plate 44 to be reliably bonded to the chip modules 60A and 60B.

In the embodiment, the Z-direction length of the communication paths 65 is set to be equal to or less than the Y-direction depth of the discharge channels 55. Accordingly, a pressure wave generated in the ink in the discharge channels 55 at the time of discharge can be reliably propagated to the nozzle holes 72A to 72D. Accordingly, the ink can be reliably discharged from the nozzle holes 72A to 72D according to driving of the discharge channels 55.

In the embodiment, the actuator plates 51A to 51D and the sub-plates 53A to 53D are formed from the same material.

According to this configuration, it is possible to relieve the stress acting on the actuator plates 51A to 51D and the sub-plates 53A to 53D caused by the difference in thermal expansion coefficient between the actuator plates 51A to 51D and the sub-plates 53A to 53D. This suppresses the separation of the actuator plates 51A to 51D and the sub-plates 53A to 53D.

The printer 1 of the embodiment includes the inkjet heads 5 described above. Accordingly, it is possible to provide the high-quality printer 1 with excellent reliability over a long period of time.

Second Embodiment

Figure 9:
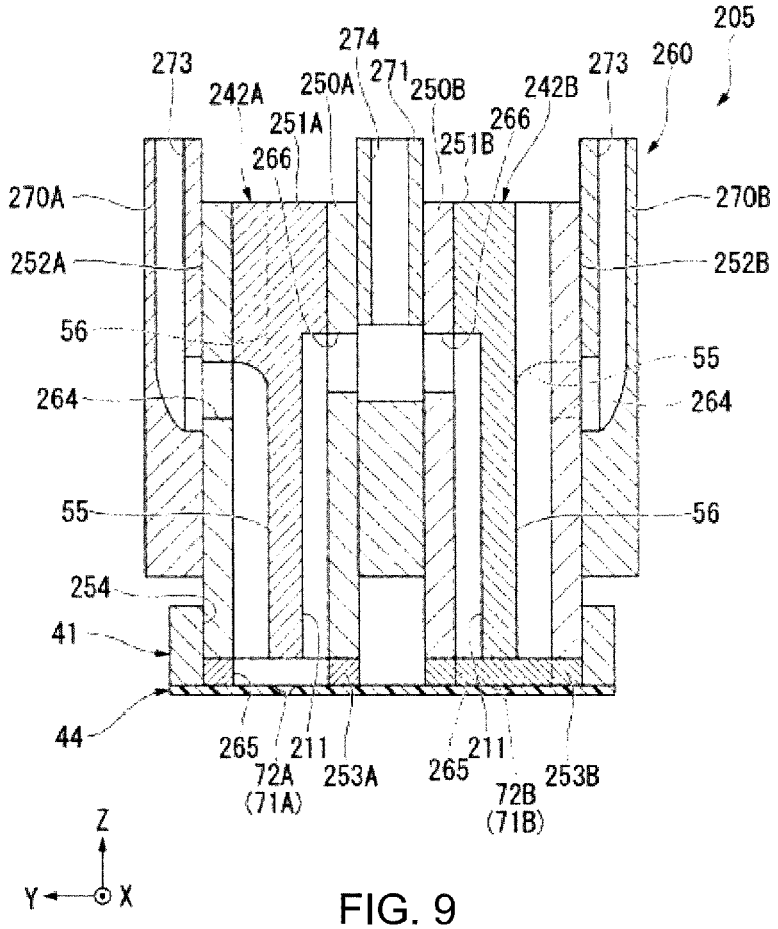
FIG. 9 is a cross-section view of an inkjet head according to a second embodiment.

Next, a second embodiment of the present invention will be described. FIG. 9 is a cross-section view of an inkjet head 205 according to the second embodiment. The embodiment is different from the foregoing embodiment in employing, among edge shoot-type inkjet heads 205, circulation (vertical circulation) inkjet heads 205 that circulate inks between the inkjet heads and the ink tanks 30. In the following description, two-line inkjet heads 205 with two head chips 242A and 242B mounted on the base member 41 will be taken for the sake of convenience. However, the configuration of the embodiment may be employed for the four-line inkjet heads 5 as in the first embodiment. In the following description, the same components as those of the first embodiment will be given the same reference signs as those of the first embodiment and descriptions thereof will be omitted.

The inkjet head 205 illustrated in FIG. 9 has the base member 41, a chip module 260, and the nozzle plate 44.

The chip module 260 has a first head chip 242A, a second head chip 242B, entrance flow path members (a first entrance flow path member 270A and a second entrance flow path member 270B), and an exit flow path member 271.

The first head chip 242A has a first actuator plate 251A, a first entrance cover plate 252A, a first exit cover plate 250A, and a first return plate (sub-plate) 253A.

The first actuator plate 251A has the discharge channels 55 and the non-discharge channels 56 alternately spaced in the X direction on the +Y-direction end surface. The first actuator plate 251A has a circulation path 211 formed on the −Y-direction end surface. The circulation path 211 is recessed from the −Y-direction end surface of the first actuator plate 251A in the +Y direction and is opened on the −Z-direction end surface of the first actuator plate 251A. Although the circulation path 211 is formed on the first actuator plate 251A in the embodiment, a circulation plate with a circulation path may be prepared separately from the first actuator plate 251A.

The first entrance cover plate 252A is bonded to the +Y-direction end surface of the first actuator plate 251A. The first entrance cover plate 252A blocks the discharge channels 55 and the non-discharge channels 56 from the +Y direction. The first entrance cover plate 252A has entrance slits 264 at positions overlapping the +Z-direction end portions of the discharge channels 55 as seen from the Y direction.

The first exit cover plate 250A is bonded to the −Y-direction end surface of the first actuator plate 251A. The first exit cover plate 250A blocks the circulation path 211 from the +Y direction. The first exit cover plate 250A has an exit slit 266 at a position overlapping the +Z-direction end of the circulation path 211 as seen from the Y direction.

The first return plate 253A is bonded at a time to the −Z-direction end surfaces of the first actuator plate 251A, the first entrance cover plate 252A, and the first exit cover plate 250A. The first return plate 253A has return paths 265 at positions overlapping the discharge channels 55 as seen from the Z direction. The return paths 265 penetrate through the first return plate 253A in the Z direction. The return paths 265 allow the corresponding discharge channels 55 to communicate with the circulation path 211. The X-direction length of the circulation path 211 is set to communicate with all the return paths 265.

As with the first head chip 242A described above, the second head chip 242B has a second actuator plate 251B, a second entrance cover plate 252B, a second exit cover plate 250B, and a second return plate (sub-plate) 253B. The same components of the plates 251B, 252B, 250B, and 253B of the second head chip 242B as those of the first head chip 242A will be given the same reference signs as those of the first head chip 242A, and descriptions thereof will be omitted.

The first entrance flow path member 270A is bonded to the +Y-direction end surface of the first head chip 242A (first entrance cover plate 252A). The first entrance flow path member 270A has an entrance flow path 273. The entrance flow path 273 communicates with the entrance slits 264. The ink supplied from the ink tank 30 is flowed in the entrance flow path 273. The ink flowed in the entrance flow path 273 is supplied to the discharge channels 55 in the first head chip 242A through the entrance slits 264.

The second entrance flow path member 270B is bonded to the −Y-direction end surface of the second head chip 242B (second entrance cover plate 252B). The ink flowed in the entrance flow path 273 of the second entrance flow path member 270B is supplied to the discharge channels 55 in the second head chip 242B through the entrance slits 264.

The exit flow path member 271 is interposed between the first head chip 242A and the second head chip 242B. Specifically, the −Y-direction end surface of the first head chip 242A (first exit cover plate 250A) is bonded to the +Y-direction end surface of the exit flow path member 271, and the +Y-direction end surface of the second head chip 242B (second exit cover plate 250B) is bonded to the −Y-direction end surface of the exit flow path member 271. The exit flow path member 271 has an exit flow path 274 communicating with the exit slits 266 in the exit cover plates 250A and 250B. The ink flowed in the circulation path 211 flows into the exit flow path 274 through the exit slit 266. The ink flowed in the exit flow path 274 is returned to the ink tank 30.

The −Z-direction end surfaces of the return plates 265A and 265B are polished. Therefore, the −Z-direction end surfaces of the return plates 265A and 265B are entirely smoothed. The head chips 242A and 242B are inserted into the attachment opening 245 in the base member 41. In the embodiment, the −Z-direction end surfaces of the base member 41 and the head chips 242A and 242B are flush with one another.

The nozzle plate 44 is bonded to the −Z-direction end surfaces of the head chips 242A and 242B (return plates 253A and 253B) and the −Z-direction end surface of the base member 41. In the embodiment, the nozzle holes 72A and 72B are formed in the nozzle plate 44 at positions overlapping the discharge channels 55 as seen from the Z direction (positions overlapping the return paths 265 in the return plates 253A and 253B). In the embodiment, the maximum flow path cross-section area of the portions of the return paths 265 nearer the circulation path 211 than the portions of the return paths 265 communicating with the nozzle holes 72A and 72B (the cross-section area orthogonal to the direction of ink flow) is preferably equal to or smaller than the flow path cross-section area of the −Z-direction openings in the discharge channels 55 (the downstream openings in the discharge channels 55).

In the inkjet head 205 of the embodiment, the ink supplied to the discharge channels 55 in the head chips 242A and 242B through the entrance slits 264 flows into the circulation path 211 through the return paths 265 in the return plates 253A and 253B. Then, the ink flowed in the circulation path 211 is returned to the ink tank 30 through the exit slit 266 and the exit flow path 274 in the exit flow path member 271. In the course of circulation of the ink between the ink tank 30 and the head chips 242A and 242B, the discharge channels 55 are deformed in such a manner to expand and contract as described above. Accordingly, part of the ink flowed in the return paths 265 is discharged through the nozzle holes 72A and 72B.

In the embodiment, the −Z-direction end surfaces of the return plates 253A and 253B are polished as described above, thereby producing the same advantages as those of the first embodiment described above.

In particular, in the embodiment, the −Z-direction end surfaces of the return plates 253A and 253B are polished to reduce the number of the components and improve the manufacturing efficiency as compared to the case of providing sub-plates separately from the return plates 253A and 253B.

In addition, in the embodiment, the maximum flow path cross-section area of the return paths 265 nearer the circulation path 211 than the portions communicating with the nozzle holes 72A and 72B is equal to or smaller than the flow path cross-section area of the −Z-direction openings of the discharge channels 55 (the downstream openings of the discharge channels 55).

According to this configuration, it is possible to suppress the situation in which the pressure wave generated in the ink in the discharge channels 55 escapes more downstream than the portions of the return paths 265 communicating with the nozzle holes 72A and 72B at the time of ink discharge. This makes it possible to propagate reliably the pressure wave generated in the ink in the discharge channels 55 to the nozzle holes 72A and 72B. Accordingly, the ink can be reliably discharged from the nozzle holes 72A and 72B according to the driving of the discharge channels 55.

The technical scope of the present invention is not limited to the foregoing embodiments but can be modified in various manners without deviating from the gist of the present invention.

For example, in the embodiment, the inkjet printer 1 is taken as an example of a liquid ejection apparatus but the present invention is not limited to this configuration. For example, the liquid ejection apparatus may be a facsimile, an on-demand printing machine, or the like. In addition, the present invention is also applicable to a large-sized printer without a conveying mechanism for conveying the recording medium P, a head-fixed printer without a scanning mechanism for scanning with the inkjet heads 5, and others.

In the foregoing embodiments, the off-carriage printer 1 loaded with the ink tanks 30 separately from the carriage 23 is taken as an example, but the present invention is not limited to this configuration. For example, the present invention is also applicable to an on-carriage printer in which ink tanks (or sub tanks) are mounted in the carriage 23.

In the foregoing embodiments, the edge shoot-type inkjet heads 5 are taken. However, the present invention is not limited to this. For example, the present invention may be applied to side shoot-type inkjet heads that discharge inks from the centers of the discharge channels 55 along the extending direction.

In the foregoing embodiment, the discharge channels 55 and the non-discharge channels 56 are alternately aligned. However, the present invention is not limited to this configuration. For example, the present invention may be applied to 3-cycle inkjet heads that discharge inks in sequence from all the channels.

In the foregoing embodiments, two head chips are bonded to each other. However, the present invention is not limited to this configuration. In the foregoing embodiments, one sub-plate is provided for one head chip. However, the present invention is not limited to this configuration. Specifically, one sub-plate may be provided for two or more head chips (for example, a plurality of head chips constituting a head module).

In the foregoing embodiments, one nozzle plate is bonded to two or four head chips. However, the present invention is not limited to this configuration. Specifically, one nozzle plate may be bonded to one head chip.

In the foregoing embodiments, the nozzle plate 44 is bonded to the sub-plate by an adhesive or the like. However, the present invention is not limited to this configuration. The method for stacking the nozzle plate 44 and the sub-plate can be changed as appropriate.

Besides, the components of the foregoing embodiments can be substituted with other known components without deviating from the gist of the present invention, and the foregoing modifications may be combined as appropriate.

What is claimed is:

1. A liquid ejection head comprising:

an actuator plate having a channel to be filled with a liquid;

a sub-plate stacked on a downstream opening surface of the channel in a flow direction of the liquid in the actuator plate and having a communication path communicating with the channel; and an ejection hole plate stacked on a downstream opening surface of the communication path in the flow direction in the sub plate and having an ejection hole communicating with the channel through the communication path, wherein the downstream opening surface of the sub-plate is polished, the actuator plate and the sub-plate constitutes a chip module, a plurality of the chip modules are aligned, and the ejection hole plate is bonded to the downstream opening surfaces of the sub-plates in the plurality of chip modules, and the downstream opening surfaces of the sub-plates in the plurality of the chip modules are flush with one another.

2. The liquid ejection head according to claim 1, wherein the channel is supplied with the liquid from a liquid supply source, and the sub-plate allows the communication path to communicate with the channel and the ejection hole and constitutes a return plate with a return path in which the liquid is flowed to the liquid supply source.

3. The liquid ejection head according to claim 2, wherein part of the liquid flowed in the return path is flowed to a circulation path communicating with the liquid supply source, and a flow path cross-section area of a portion of the return path positioned nearer the circulation path than the portion of the return path communicating with the ejection hole is equal to or smaller than a flow path cross-section area orthogonal to the flow direction at the downstream opening surface of the channel.

4. The liquid ejection head according to claim 1, wherein the actuator plate and the sub-plate are formed from the same material.

5. A liquid ejection apparatus, comprising the liquid ejection head according to claim 1.

6. A method for manufacturing a liquid ejection head including: an actuator plate having a channel to be filled with a liquid; and a sub-plate stacked on a downstream opening surface of the channel in a flow direction of the liquid in the actuator plate and having a communication path communicating with the channel, wherein the method comprises:

a polishing step of polishing a downstream opening surface of the communication path in the sub-plate along the flow direction;

a stacking step of stacking an ejection hole plate having an ejection hole communicating with the channel through the communication path on the downstream opening surface of the sub-plate, and wherein the actuator plate and the sub-plate constitute a chip module, and in the polishing step, the downstream opening surfaces of the sub-plates in a plurality of the chip modules are collectively polished, and in the stacking step, the ejection hole plate is stacked to the downstream opening surfaces of the sub-plates in the plurality of chip modules.

* * * * *